US005393453A

United States Patent [19]

Mondin et al.

[11] Patent Number: 5,393,453

[45] Date of Patent: Feb. 28, 1995

[54] THICKENED COMPOSITION CONTAINING GLYCOLIPID SURFACTANT AND POLYMERIC THICKENER

[75] Inventors: Myriam Mondin, Seraing; Guy Broze, Grace-Hollogne, both of Belgium

[73] Assignee: Colgate Palmolive Co., Piscataway, N.J.

[21] Appl. No.: 190,935

[22] Filed: Feb. 3, 1994

[51] Int. Cl.[6] ..... C11D 3/22; C11D 3/37; C11D 1/12

[52] U.S. Cl. ..... 252/174.18; 252/174.23; 252/173; 252/142; 252/550; 252/554; 252/544; 252/DIG. 2; 252/DIG. 14; 134/40; 134/42

[58] Field of Search ..... 252/89.1, 174.23, 142, 252/173, 174.18, 174.17, DIG. 14, DIG. 2, 550, 554, 544; 134/40, 42

[56] References Cited

U.S. PATENT DOCUMENTS 5,077,039 12/1991 Baur et al. ..... 424/70
5,108,643 4/1992 Loth et al. ..... 252/174.11
5,169,553 12/1992 Durbut et al. ..... 252/99

FOREIGN PATENT DOCUMENTS 0487262 5/1992 European Pat. Off. ..... 252/174.17
0499434 8/1992 European Pat. Off. ..... 252/174.17

*Primary Examiner*—Paul Lieberman
*Assistant Examiner*—Lorna M. Douyon
*Attorney, Agent, or Firm*—Richard E. Nanfeldt; Robert C. Sullivan

[57] ABSTRACT

A thickened composition having a complex viscosity at 25° C. and at 1.58 Hz of about 0.1 to about 200 Pascal seconds, a G′ value of about 0.1 to about 15000 dynes/sq cm over a strain range of 1 to 5% and a G″ value of about 0.1 to about 2000 dynes/sq cm over a strain range of 1 to 5% which comprises approximately by weight 2 to 25 wt % of a glycolipid surfactant having an HLB of about 0.1 to about 8.0; 0.1 to 10.0 wt % of a polymeric thickener; 0.1 to 8 wt. % of an anionic surfactant; and the balance being water.

9 Claims, No Drawings

THICKENED COMPOSITION CONTAINING GLYCOLIPID SURFACTANT AND POLYMERIC THICKENER

This invention relates to a thickened surfactant containing composition and the processes for the manufacture and use thereof. More particularly, it relates to a thickened stable surfactant containing composition in concentrated form which is effective to clean soils from substrates such as bathroom fixtures and walls. The thickened compositions more readily clings to a vertical surface and has less tendency to sag or run down the vertical surface than these microemulsions described in U.S. Pat. Nos. 5,076,954, 4,91 9,839, 5,075,026 and 5,082,584. The instant described thickened compositions comprise a synthetic glycolipid detergent, an anionic surfactant, water and an associative polymeric thickener which causes a lipophilic interaction between the glycolipid surfactant, the anionic surfactant and the associative thickener. When the pH of the composition is on the acid side, preferably in the range of 1 to 5, the invented compositions could be useful for removing lime scale and soap scum from hard substrates.

Liquid detergent compositions, usually in solution or emulsion form, have been employed as all-purpose detergents and have been suggested for cleaning hard surfaces such as painted woodwork, bathtubs, sinks, tile floors, tiled walls, linoleum, paneling and washable wallpaper. Many such preparations, such as those described in U.S. Pat. Nos. 2,560,839, 3,234,138, and 3,350,319, and British Patent Specification No. 1223739, include substantial proportions of inorganic phosphate builder salts, the presence of which can sometimes be found objectionable for environmental reasons and also because they necessitate thorough rinsing of the liquid detergent from the cleaned surface to avoid the presence of noticeable depositings of phosphate thereon. In U.S. Pat. Nos. 4,017,409 and 4,244,840 liquid detergents of reduced phosphate builder salt contents have been described but such may still require rinsing or can include enough phosphate to be environmentally objectionable. Some liquid detergents have been made which are phosphate-free, such as those described in U.S. Pat. No. 3,935,130 but these normally include higher percentages of synthetic organic detergent, which increased detergent content may be objectionable due to excessive foaming during use that can result from its presence. The previously described liquid detergent compositions are emulsions but are not disclosed to be microemulsions like those of the present invention.

Microemulsions have been disclosed in various patents and patent applications for liquid detergent compositions which may be useful as hard surface cleaners or all-purpose cleaners, and such compositions have sometimes included detergent, solvent, water and a co-surfactant. Among such disclosures are European Patent Specifications Nos. 0137615, 0137616 and 0160762, and U.S. Pat. No. 4,561,991, all of which describe employing at least 5% by weight of the solvent in the compositions. The use of magnesium salts to improve grease removing performance in microemulsion liquid detergent compositions is mentioned in British Patent Specification No. 2144763. Other patents on liquid detergent cleaning compositions in microemulsion form are U.S. Pat. Nos. 3,723,330, 4,472,291 and 4,540,448. Additional formulas of liquid detergent compositions in emulsion form which include hydrocarbons, such as terpenes, are disclosed in British Patent Specifications Nos. 1603047 and 2033421, European Patent Specification No. 0080749, and U.S. Pat. Nos. 4,017,409, 4,414,128 and 4,540,505. However, the presence of builder salts in such compositions, especially in the presence of magnesium compounds, tends to destabilize the microemulsions and therefore such builders are considered to be undesirable.

Although the cited prior art relates to liquid all-purpose detergent compositions in emulsion form and although various components of the present compositions are mentioned in the art, it is considered that the art does not anticipate or make obvious subject matter disclosed and claimed herein. In accordance with the present invention a stable thickened surfactant containing composition comprises a synthetic glycolipid detergent, an anionic surfactant, an associative polymer thickener, a water insoluble aliphatic hydrocarbon and water, thereby producing a stable thickened composition which is stable at room temperatures. The compositions are especially effective for cleaning soils from substrates, and when the compositions are acidic they could also useful to remove lime scale and soap scum from hard surfaces such as bathroom fixtures, floors and walls.

SUMMARY OF THE INVENTION

The present invention provides a stable thickened surfactant containing composition which is suitable for cleaning vertical hard surfaces such as plastic, vitreous and metal surfaces.

In one aspect of the invention a stable thickened composition which is especially effective in the removal of soil from hard surfaces comprises on a weight basis: 0.25 to 25% of a synthetic glycolipid detergent, 0.1 to 8% of an anionic surfactant, about 0.1 to about 10.0 wt % of an associative polymeric thickener wherein the associative polymer thickener forms connecting lipophilic-lipophilic bridges between the synthetic glycolipid detergent, an anionic surfactant and the associative thickener and 15 to 76% of water, said proportions being based upon the total weight of the composition.

Preferred concentrations of the mentioned components of the thickened composition comprises approximately by weight 0.35 to 20% of the synthetic glycolipid detergent, 0.4 to 6% of the anionic surfactant, 0.5 to 8.0% of the associative polymeric thickener, and 15 to 64% of water. The cleaning composition comprise the described components with minor proportions of compatible adjuvants being permissible. Among the desirable adjuvants that may be present in the thickened compositions are divalent or polyvalent metal salts, as sources of magnesium and aluminum, for example, which improve cleaning performances of the dilute compositions, and higher fatty acids and/or higher fatty acid soaps, which act as foam suppressants.

DETAILED DESCRIPTION OF THE INVENTION

The present invention relates to thickened surfactant containing compositions which approximately by weight comprise:

(a) 2 to 25 percent of a glycolipid surfactant;
(b) 0.1 to 10.0 percent of an associative thickener polymer;
(c) 0.1 to 38 percent of an anionic surfactant; and
(d) balance being water.

The synthetic glycolipid detergent of the instant invention are made through an enzyme catalyzed synthesis and contain only one unit. These glycolipid detergents are sold by Novo Chemical Co. under the trade name Biosurf 12 and Biosurf tall. The glycolipid detergents are characterized by the formula:

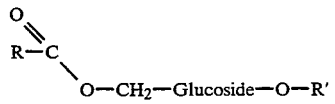

R = $C_{10}$, $C_{12}$, Tallow
R'= Ethyl or Isopropyl wherein R is a saturated or unsaturated alkyl group having 12 to 20 carbon atoms more preferably 12 to 14 carbon atoms, wherein R is preferably an alkyl group, and R' is an ethyl or isopropyl group. The glycolipid detergent is contained in the thickened composition at a concentration of about 0.25 to 25 wt %, more preferably about 0.25 to about 10 wt %.

The composition also contains about 0.1 to about 8 wt % of an anionic surfactant, more preferably about 0.4 to about 6 wt %. The preferred anionic surfactants are alkali metal paraffin sulfonates or alkali metal alkyl ether sulfates.

The alkali metal paraffin sulfonates used in the compositions of the present invention are usually mixed secondary alkyl sulfonates having from 10 to 20 carbon atoms per molecule; preferably at least 80%, usually at least 90%, of the alkyl groups will have 13–17 carbon atoms per molecule. Where the major proportion has 14–15 carbon atoms per molecule, optimum foaming performance appears to be obtained at varying concentrations and water hardnesses. These sulfonates are preferably prepared by subjecting a cut of paraffin, corresponding to the chain lengths specified above, to the action of sulphur dioxide and oxygen in accordance with the well-known sulphoxidation process. The product of this reaction is a secondary sulphonic acid which is then neutralized with a suitable alkali metal base to provide the alkali metal water soluble secondary alkyl sulfonate suitable for use in the present invention. Similar useful secondary alkyl sulfonates may be obtained by other methods, e.g. by the sulphoclorination method in which chlorine and sulphur dioxide are reacted with paraffins in the presence of actinic light, the resulting sulphonyl chlorides being hydrolyzed and neutralized to form the secondary alkyl sulfonates.

The paraffin sulfonates are water soluble salts of an alkali metal such as sodium or potassium or a triethanol amine salt.

The polymeric associative thickeners are manufactured and sold by BASF Company under the name Pluracol TH922 and Pluracol TH916. These polymeric associative thickeners are nonionic polymers obtained by the reaction of an alkylene oxide copolymer having a molar mass of about 5000 to 50,000 and having an OH functionality at each end of the polymeric chain with two long alkyl chain epoxides each of which has about 12 to about 24 carbon atoms. The associative polymeric thickener can be characterized by the formula:

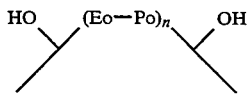

wherein n is about 20 to about 500 and the ratio of Eo to Po is 3:1

The concentration of the associative polymeric thickener in the thickened composition is about 0.1 to about 10.0 wt %, more preferably about 0.1 to about 4 wt % and most preferably about 0.1 to about 2.5 wt %.

The final essential component of the invented thickened composition is water. Such water may be tap water, usually of less that 150 ppm hardness, as $CaCO_3$, but preferably will be deionized water or water of hardness less than 50 ppm, as $CaCO_3$. The proportion of water in the thickened composition is from about 45 to about 95 wt % and more preferably about 60 to about 90 wt %.

The thickened compositions of the instant invention may also optionally contain about 0.1 to about 10.0 wt. percent of an acidic component.

The active acidic component of the thickened composition can optionally be a carboxylic acid which is strong enough to lower the pH of the thickened composition to one in the range of one to four. Various such carboxylic acids can perform this function but those which have been found effectively to remove soap scum and lime scale from the bathroom surfaces best, while still not destabilzing the emulsion, are polycarboxylic acids, and of these the dicarboxylic acids are preferred. Of the dicarboxylic acids group, which includes those of 2 to 10 carbon atoms, from oxalic acid through sebacic acid, suberic, azelaic and sebacic acids are of lower solubilities and therefore are not as useful in the present thickened composition as the other dibasic aliphatic fatty acids, all of which are preferably saturated and straight chained. Oxalic and malonic acids, although useful as reducing agents too, may be too strong for delicate hard surface cleanings. Preferred such dibasic acids are those of the middle portion of the 2 to 10 carbon atom acid range, succinic glutaric, adipic and pimelic acids, especially the first three thereof, which fortunately are available commercially, in mixture. The diacids, after being incorporated in the invented thickened composition may be partially neutralized to produce the desired pH in the thickened composition, for greatest functional effectiveness, with safety.

Phosphoric acid is one of the additional acids that helps to protect acid-sensitive surfaces being cleaned with the present thickened composition. Being a tribasic acid, it too may be partially neutralized to the biphosphate, e.g., $NaH_2PO_4$, or $NH_4H_2PO_4$.

Phosphonic acid, the other of the two additional acids for protecting acid-sensitive surfaces from the dissolving action of the dicarboxylic acids of the present emulsions, apparently exists only theoretically, but its derivatives are stable and are useful in the practice of the present invention. Such are considered to be phosphonic acids, as that term is used in this specification. The phosphonic acids are of the structure.

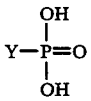

wherein Y is any suitable substituent, but preferably Y is alkylanmino or N-substituted alkylamino. For example, a preferred phosphonic acid component of the present emulsions is aminotris-)methylenephosphonic) acid, which is of the formula $N(CH_2PH_2O_3)$. Among other useful phosphonic acids are ethylenediamine tetra(methylenephosphonic) acid, hexamethylenediamine tetra-(methylenephosphonic) acid, and diethylenetriamine penta-(methylenephosphonic) acid. Such class of compounds may be described as aminoalkylenephosphonic acids containing in the ranges of 1 to 3 amino nitrogens, 3 or 4 lower alkylenephosphonic acid groups of 2 to 6 carbon atoms each, which alkylene(s) is/are present and join amino nitrogens when a plurality of such amino nitrogens is present in the aminoalkylenephosphonic acid. It has been found that such aminoalkylenephosphonic acids, which also may be partially neutralized at the desired pH of the are of desired stabilizing and protecting effect in e invented cleaner, especially when present with phosphoric acid, preventing harmful attacks on European enamel surfaces by the diacid(s) components of the cleaner. Usually the phosphorus acid salts, if present, will be mono-salts of each of the phosphoric and/or phosphonic acid groups present.

Of all the organic acids which are of sufficient acidity effectively to attack soap scum and to convert it to a form which is readily removable from hard surfaces, such as ceramic tiles, portland cement and acrylic latex grouts between the tiles, porcelain, porcelain enamel, glass, fiberglass and metal (such as chrome and nickel plated) surfaces, glutaric acid or a partially neutralized salt or ionized form thereof is highly preferred, because it performs effectively and has no significantly detrimental negative properties, but in some instances other acids capable of converting calcium and magnesium higher fatty acid soaps to acidic or partially neutralized form to assist in removing them from hard surfaces which they are staining (in the form of soap scum) may also be employed (when detrimental properties thereof, if any, are tolerable). Such acids will include those which do not form water insoluble calcium salts. For example, acetic acid, succinic acid, propionic acid and citric acid may be utilized in some circumstances. However, citric acid is a sequestering acid and tends to remove calcium from calcium carbonate in the grout employed between adjacent ceramic tiles, which is detrimental to its use, and the other mentioned acids are often unsatisfactory because of unacceptable odors and/or because they result in human nasal and/or respiratory irritation. Of course, those acids which are toxic under the circumstance of use will also preferably be avoided. Therefore, glutaric acid is preferably utilized as such soap scum attacking acid. It may be (and usually is) subsequently partially neutralized to the desired pH range during manufacture of the invented cleaner but it is also within the invention to employ salts of such acid and to convert them to the desired pH, where it is recognized that the products of both such operations are the same. Therefore, by reference to "partially neutralized glutaric acid" it is meant also to include such products resulting from partially acidifying glutaric acid salts (glutarates) or from directly incorporating the partially neutralized glutarates of desired pH with the other components of the cleaner.

The thickened composition of this invention may, if desired, also contain other components, either to provide additional beneficial effects or to make the product more attractive to the consumer. The following are mentioned by way of examples: colors or dyes in proportions from 0.01 to 0.5%; bactericides in proportions from 0.01 to 1%; and preservatives or antioxidizing agents, such as formalin, 5-bromo-5-nitrodioxan-1,3,5-chloro-2-methyl-4-isothaliazolin-3-one, 2,6-di-tert, butyl-p-cresol, in proportions from 0.01 to 2%. Furthermore, if opaque or pearlescent compositions are desired, up to 4% by weight of opacifier and/or pearlescing agent may be added.

The thickened compositions exhibit a complex viscosity at room temperature in the range of 0.1 to 200 Pascal seconds at a frequency of 1.58 Hz, more preferably about 0.1 to about 100 Pascal seconds at a frequency of 1.58 Hz, an elastic modulus G′ value of about 0.1 to about 15000 dynes/sq cm over a strain range of 1 to 50% and a viscous modulus G″ value of about 0.1 to about 2000 dynes/sq cm over a strain range of 1 to 50%. The thickened compositions exhibit viscoelastic gel-like properties.

The thickened liquid compositions are preferably packaged in containers of synthetic organic polymeric plastic, e.g., PVC, polyethylene or polypropylene and PET.

The process for forming the thickened compositions of the instant invention comprises: forming a solution of the water and the glycolipid surfactant and the anionic surfactant and heating the formed solution to above 40° C. at which point the associative thickener is slowly added with stirring to the heated solution. Stirring and heating are continued until a homogenous solution has been obtained and then the solution is cooled to room temperature to form the thickened composition.

EXAMPLE 1

The following examples were prepared but the previously described process, wherein the amounts as stated are in weight percent.

| | A | B | C | D | E | F | G | H | I | J | K | L | M | N | O | P |
|---|---|---|---|---|---|---|---|---|---|---|---|---|---|---|---|---|
| Biosurf 12 | 4 | 5.1 | 6.3 | 8 | 10 | 12.5 | 15.8 | 2.5 | | | | | | | | |
| Biosurf Tallow | — | — | — | — | — | — | — | — | 4 | 5.1 | 6.3 | 8 | 10 | 12.5 | 15.8 | 2.5 |
| Paraffin sulfonate | 2.5 | 2.5 | 2.5 | 2.5 | 2.5 | 2.5 | 2.5 | 2.5 | 2.5 | 2.5 | 2.5 | 2.5 | 2.5 | 2.5 | 2.5 | 2.5 |
| Pluracol TH922 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 |
| Water | Bal | Bal | Bal | Bal | Bal | Bal | Bal | Bal | Bal | Bal | Bal | Bal | Bal | Bal | Bal | Bal |
| G′ dynes/cm | 1330 | 1500 | 1110 | 800 | 750 | 1825 | 1575 | 2000 | 1625 | 1300 | 1100 | 875 | 670 | 1550 | 2000 | 11000 |
| G″ dynes/cm | 540 | 410 | 210 | 60 | 50 | 100 | 240 | 500 | 110 | 110 | 100 | 50 | 75 | 130 | 290 | 1450 |
| Complex viscosity Pascal seconds | 54 | 41 | 21 | 6 | 5 | 10 | 24 | 50 | 11 | 11 | 10 | 5 | 7.5 | 13 | 29 | 145 |

The rheological measerements were done at a 1.58 Hz frequency at 25° C.

The invented subject matter has been described with respect to various embodiments and working examples but it is not to be construed as limited to these because it is evident that one of skill in the art, with the present specification before him, will be able to utilize substitutes and equivalents without departing from the scope of the invention herein described.

What is claimed is:

1. A thickened composition having a complex viscosity at 25° C. and 1.58 Hz of about 0.1 to about 200 Pascal seconds, an elastic modulus G′ value of about 0.1 to about 15000 dynes/sq cm over a strain range of 1 to 5% and a viscous modulus G″ value of about 0.1 to about 2000 dynes/sq cm over a strain range of 1 to 5% which comprises approximately by weight:

(a) 0.25 to 25% of a glycolipid surfactant having an HLB of about 0.1 to about 8.0;

(b) 0.1 to 10.0% of a polymeric thickener which is a nonionic polymer wherein said nonionic polymer is the reaction product of an alkylene oxide copolymer having a molar mass of about 5000 to 50,000 and having an OH functionality at each end of the polymer chain and two alkyl chain epoxides, each of which has about 12 to about 25 carbon atoms; (c) 0.1 to 8% of an anionic surfactant; and (d) the balance being water, wherein said polymeric thickener forms lipophilic-lipophilic bridges with said glycolipid surfactant and said anionic surfactant.

2. A composition according to claim 1, wherein said glycolipid surfactant has the formula:

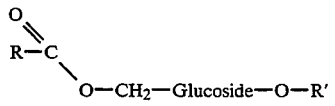

wherein R is a saturated or unsaturated alkyl group having about 12 to about 20 carbon atoms and R′ is an ethyl or propyl group.

3. A composition according to claim 1, wherein said anionic surfactant is a sodium paraffin sulfonate.

4. A composition according to claim 1, wherein said anionic surfactant is an alkali metal alkyl sulfate.

5. A composition according to claim 1, further including about 0.1 to about 10 wt. % of an aliphatic carboxylic acid.

6. A composition according to claim 1, further including about 0.1 to about 25 wt. % of a fabric softener.

7. A process for diluting the stable thickened aqueous cleaning composition of claim 1 to produce a diluted stable aqueous cleaning composition of claim 1, which comprises adding up to four parts by weight of water at a temperature in the range of 5° to 50° C. to one part by weight of a composition of claim 1 which is at substantially the same temperature while maintaining mixing of the composition during the adding of water.

8. A process for removing oily soils from surfaces which comprises applying to such surfaces from which the oily soil is to be removed a composition of claim 1, whereby the oily soil is absorbed into the dispersed lipophilic phase of the composition and removing such composition and the oily soil from such surface.

9. A process according to claim 7, wherein such removal is effected by wiping a normally shiny such surface without rinsing or by wiping after minimal rinsing, producing a surface which is shiny after such wiping and drying.

* * * * *